United States Patent [19]

Schutz

[11] Patent Number: 4,909,387

[45] Date of Patent: Mar. 20, 1990

[54] PALLET CONTAINER WITH AN EXCHANGEABLE INNER CONTAINER OF A SYNTHETIC RESIN AND AN OUTER JACKET OF METAL LATTICE BARS

[76] Inventor: Udo Schutz, Ruckersteg 4, D-5418 Selters, Fed. Rep. of Germany

[21] Appl. No.: 296,125

[22] Filed: Jan. 12, 1989

[30] Foreign Application Priority Data

Nov. 24, 1988 [DE] Fed. Rep. of Germany ..... 3839647

[51] Int. Cl.[4] ..... B65D 19/00

[52] U.S. Cl. ..... 206/386; 220/1.5; 220/19; 220/72.1; 220/401

[58] Field of Search ..... 220/18.1, 70.1, 72.1, 220/401, 84, 19, 1.5; 206/386; 222/105, 183

[56] References Cited

U.S. PATENT DOCUMENTS

| | | | |
|---|---|---|---|
| 2,949,207 | 8/1960 | Rehrig | 220/19 |
| 3,707,033 | 12/1972 | Knott | 220/19 X |
| 4,053,079 | 10/1977 | Karpisek | 220/1.5 X |
| 4,173,288 | 11/1979 | Schutz | 220/1.5 |
| 4,676,373 | 6/1987 | Schneider | 206/386 |
| 4,756,138 | 7/1988 | Karpisek | 206/386 X |
| 4,795,057 | 1/1989 | Jungels et al. | 220/401 |

FOREIGN PATENT DOCUMENTS

| | | | |
|---|---|---|---|
| 2811655 | 9/1979 | Fed. Rep. of Germany | 206/386 |
| 3039635 | 10/1985 | Fed. Rep. of Germany . | |
| 2596360 | 10/1987 | France . | |

*Primary Examiner*—Bryan P. Gehman
*Attorney, Agent, or Firm*—Young & Thompson

[57] ABSTRACT

The pallet container comprises a wooden pallet or a steel pipe pallet, on which is mounted an inner container of a synthetic resin with a jacket of vertical and horizontal lattice bars (4, 5) of steel pipe, these bars forming continuous inner and outer tangential planes; (20-20, 25-25). At the points of intersection (15), the lattice bars are drawn in to form trough-like indentations. This configuration has the result that, at each point of intersection (15), four contact points (22) disposed in one plane (21-21) are produced with an accumulation of material in each case corresponding to four times the wall thickness of the lattice bars. The lattice bars (4, 5) are joined together at the points of intersection (15) in the zone of the contact points (22) by electric resistance welding. The pallet container is usable as a safely operating multiple-trip container for liquid merchandise of all kinds.

16 Claims, 8 Drawing Sheets

PALLET CONTAINER WITH AN EXCHANGEABLE INNER CONTAINER OF A SYNTHETIC RESIN AND AN OUTER JACKET OF METAL LATTICE BARS

The invention relates to pallet containers with a flat pallet, an exchangeable inner container of a synthetic resin with an upper filling port and a lower discharge means, as well as an outer jacket surrounding the inner container and made up of a latticework with vertical and horizontal lattice bars of metal.

Such pallet containers, known from German Patent No. 3,039,635 as well as French Laid-Open Application No. 2,596,360, designed as multiple-trip containers, are utilized for the storage and for the transportation of liquid goods of all types of the chemical, pharmaceutical, mineral oil, and grocery industries.

The invention is based on the object of improving the conventional pallet container with respect to its stability and the possibility of its automated manufacture, and of providing a number of solution possibilities for the connection of the lattice bars of the outer jacket with continuously extending upper and lower marginal profile members.

This object has been attained, starting with a pallet container of the type described hereinabove, by the characterizing features of claim 1.

The dependent claims contain suitable further developments of the invention.

The pallet container according to this invention is distinguished by the following advantages:

The lattice box pallet container saves weight as compared with the pallet containers with lattice boxes made up of solid bars, known from German Patent No. 3,039,635 as well as French Laid-Open Application No. 2,596,360, and attains a substantially higher stability. The special configuration of the cross connections with the doublewalled indentations provided at the points of intersection by drawing in the tubular lattice bars, and the four contact points, resulting from this configuration and located in one plane, with an accumulation of material corresponding in each case to four times the tubular wall thickness, permits an optimum weld bond of the lattice bars at the points of intersection by resistance forge welding within the scope of an automated mass production. Finally, the cross connections of the lattice bars of the lattice box utilized as an outer shell for the pallet container are distinguished by a great resistance moment against the effects of external force as well as the internal forces produced by the filling material.

The invention will be described in greater detail below with reference to embodiments illustrated in the drawings wherein.

Figure 5:
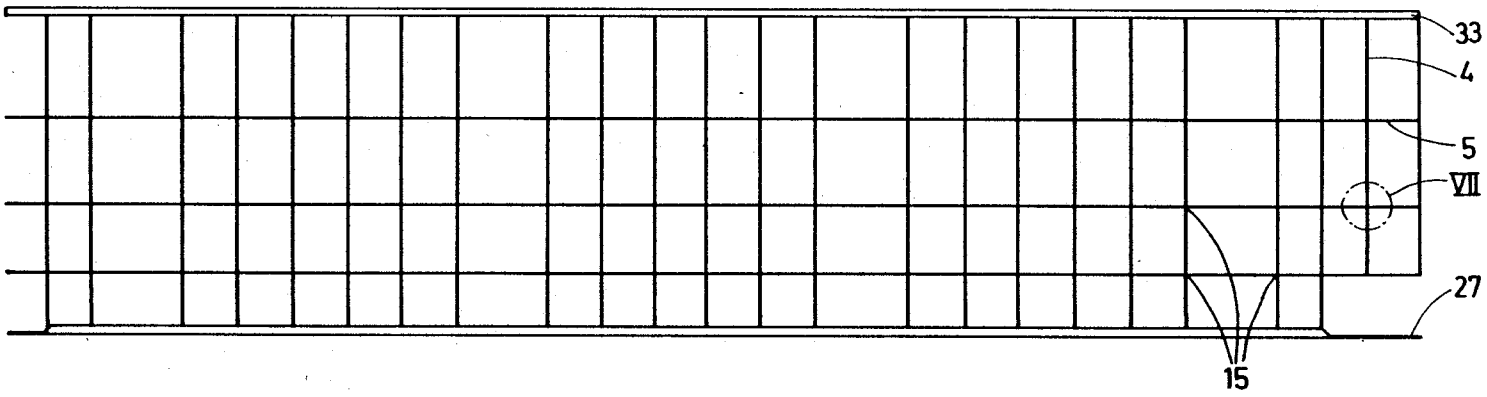
Figure 6:
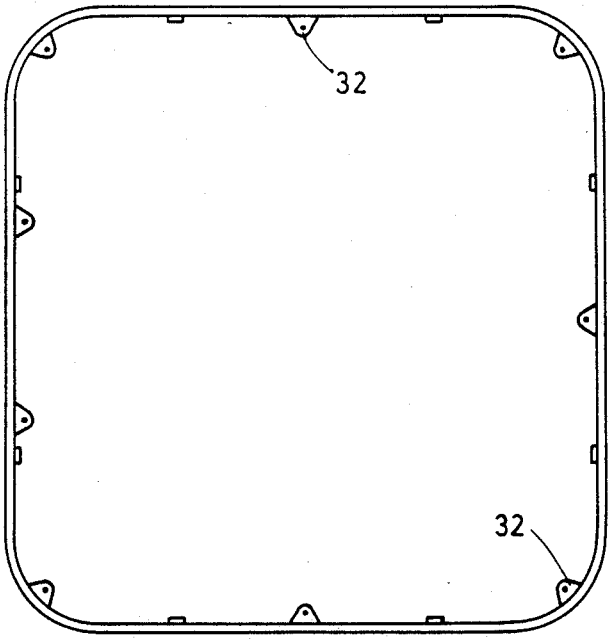
Figure 7:
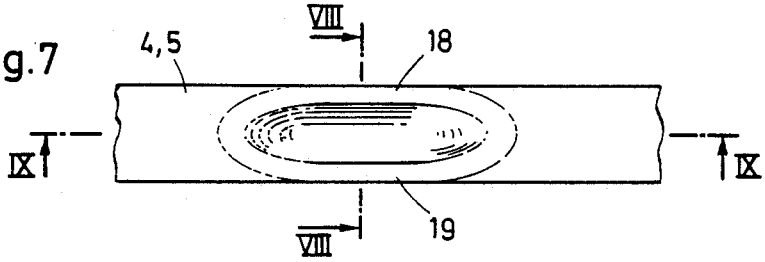
Figure 8:
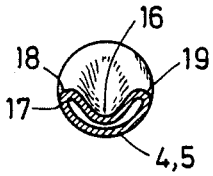
Figure 9:
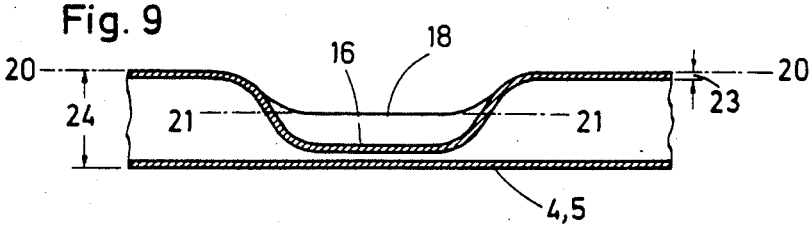
Figure 10:
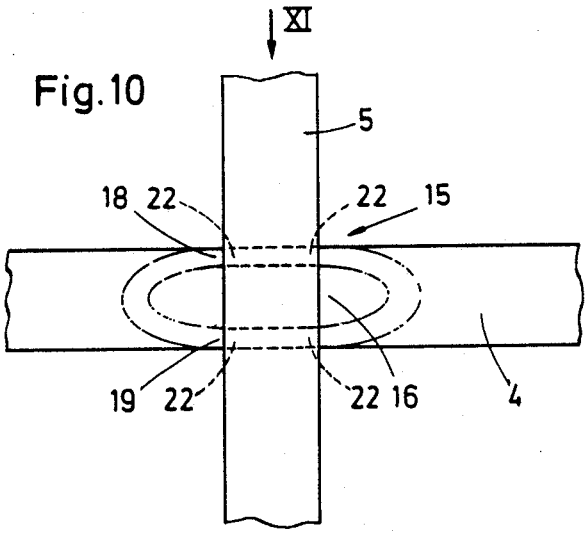
Figure 11:
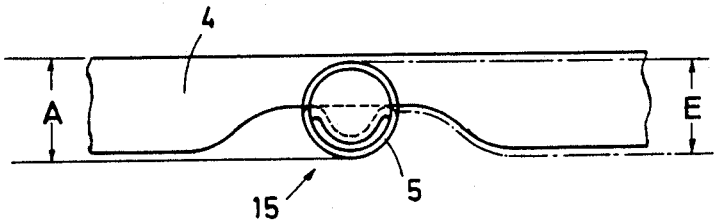
Figure 12:
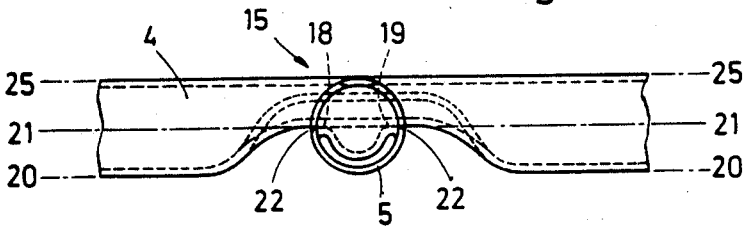
Figure 19:
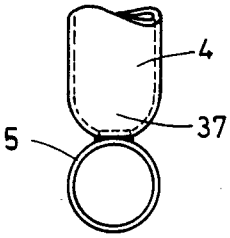
Figure 20:
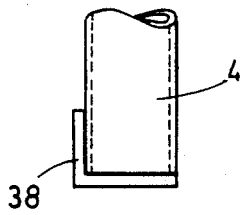
Figure 21:
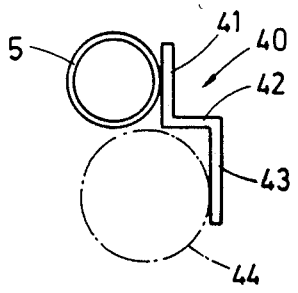
Figure 22:
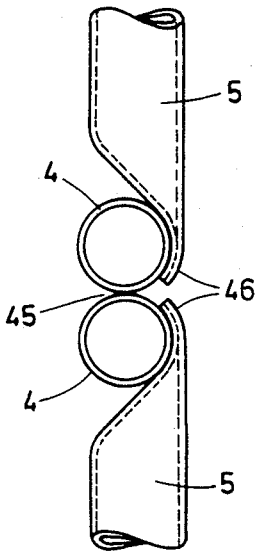
Figure 23:
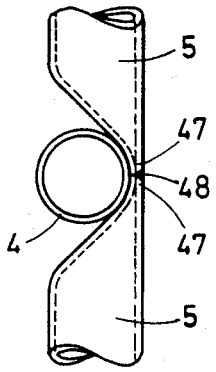
Figure 24:
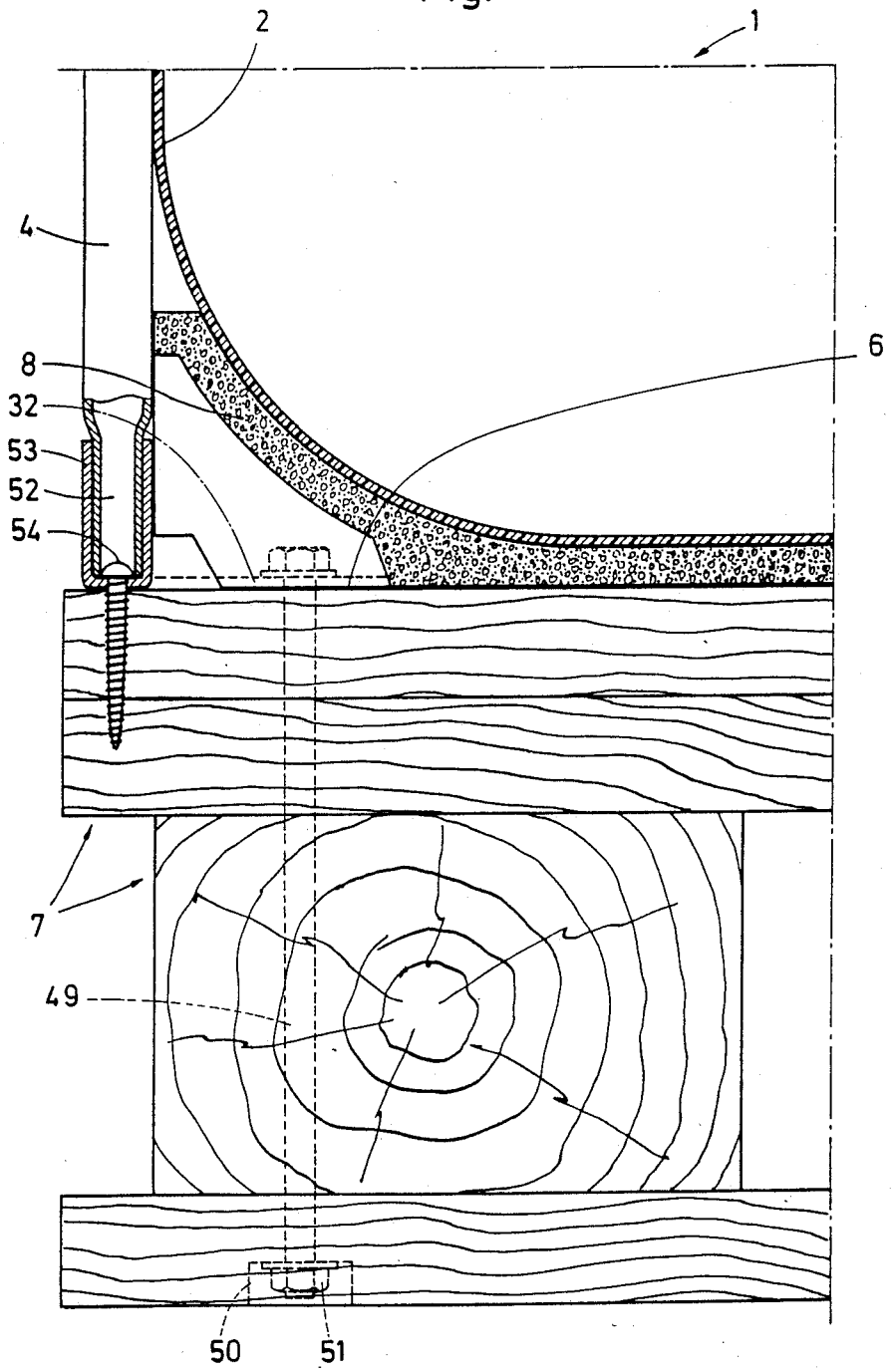

FIG. 5 is a developed view (prefabrication stage) of the lattice shell with lattice bars fashioned as pipes, FIG. 6 is a top view of the finished, bent lattice shell, FIG. 7 is a view of a lattice bar with a drawn-in indentation, FIG. 8 is a cross section of the lattice bar according to line VIII—VIII of FIG. 7, FIG. 9 is a central longitudinal section of the lattice bar along line IX—IX of FIG. 7, FIG. 10 is a top view of a point of intersection of two lattice bars prior to welding of the bars, FIG. 11 is a view of the point of intersection of two lattice bars in the direction of arrow XI in FIG. 10, FIG. 12 is a view, corresponding to the view of FIG. 11, of a point of intersection of two lattice bars after welding of the bars, FIGS. 13 through 20 show various possibilities of connecting the vertical lattice bars with continuously extending upper or lower marginal profiles of the lattice shell, FIG. 21 shows the mounting of the lattice shell on a steel pipe pallet, FIGS. 22 and 23 show two embodiments of a butt joint of the lattice shell of the pallet container, and FIG. 24 shows an enlarged partial sectional view of the lower portion of a pallet container with wooden pallet.

Figure 1:
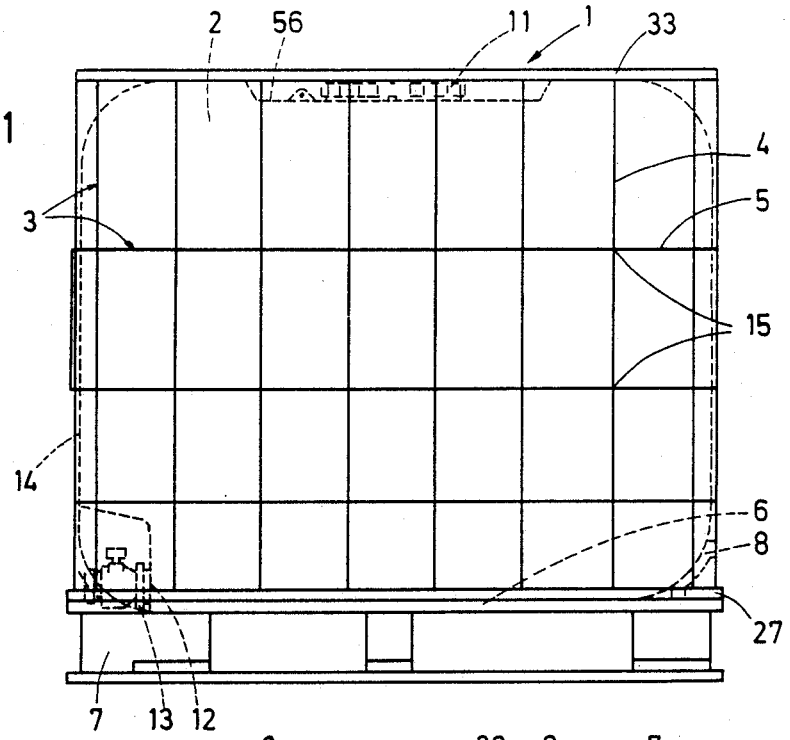
FIG. 1 is a lateral view of a pallet container with a wooden pallet.
Figure 2:
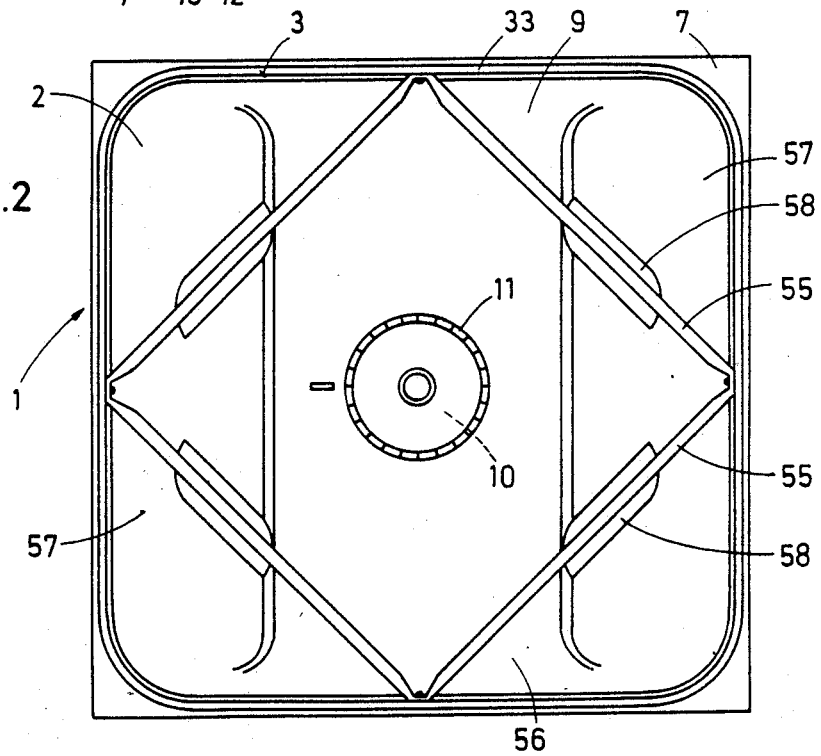
FIG. 2 is a top view of the pallet container according to FIG. 1.

The pallet container 1 according to FIGS. 1 and 2 for the storage and for the conveyance of liquid material comprises, as the primary component, an exchangeable inner container 2 of polyethylene with a rectangular and, respectively, square outer contour and rounded corners and edges, as well as an outer shell 3 of intersecting vertical and horizontal lattice bars 4, 5 of steel pipe, and a sheet-metal bottom 6. The pallet container 1 is attached to a wooden pallet 7. A support ring 8 of polystyrene foam acting as a vibration damper is arranged between the lower rounded rim of the synthetic resin inner container 2, the lattice shell 3 and the wooden pallet 7 (FIG. 24).

The inner synthetic resin container 2 exhibits in the center of its upper wall 9 a filling port 10 that can be sealed by means of a screw lid 11. At its lowest point, the inner container 2 has an outlet opening 12 which is likewise closed by means of a screw cap 13 and additionally with a film, laminated with a synthetic resin (not illustrated), so that after unscrewing the cap 13 a corresponding tap fitting, e.g. a pound-in faucet or screw-on faucet, can be attached.

The vertical and horizontal lattice bars 4, 5 of the outer shell 3 are in close contact with the outer wall 14 of the inner container 2 and constitute continuously extending outer and inner boundary planes so that "climbing" of neighboring pallet containers on account of twisting of the loading surface when the containers are transported, for example, with a truck, is precluded.

At the points of intersection 15, the vertical and horizontal lattice bars 4, 5 are drawn in for the formation of trough-like, double-walled indentations 16 extending in the longitudinal direction of the bars, in such a way that the two curved longitudinal rims 18, 19 of the wall 17 of the indentations 16 in the tubular bars 4, 5 extend between a tangential plane 20-20 and a secant plane 21-21 of the lattice bars, parallel to the first-mentioned plane (FIG. 9). This configuration of the lattice bars 4, 5 has the effect that there are produced at each point of intersection 15 between the longitudinal rims 18, 19 of the indentations 16 of two rectangularly superimposed lattice bars, four contact points 22 located in one plane, namely the secant plane 21-21, with respectively an accumulation of material corresponding to four times the wall thickness 23 of the lattice bars 4, 5 (FIGS. 10–12). The indentations 16 produced in the lattice bars 4, 5 are dimensioned so that the starting dimension A measured in the direction of the normal through the points of intersection 15 prior to welding the assembled lattice bars 4, 5 together is larger than one external lattice bar diameter 24 (FIG. 11). The lattice bars 4, 5 are joined at the points of intersection 15 in each case in the region of the four contact points 22 by resistance forge welding in such a way that the starting dimension A is reduced under pressure to the final dimension E corresponding to an outer diameter 24 of the lattice bar, and the lattice bars 4, 5 exhibit on the inside and outside joint tangential planes 20-20 and 25-25 (FIG. 12).

On account of the accumulation of material of four times the lattice bar wall thickness 23 at each of the four contact points 22 at all points of intersection 15 of the vertical and horizontal lattice bars 4, 5 of the outer shell 3, the result is achieved that with a corresponding control of the welding current and the pressure of the welding press, a current will flow via the contact points 22 producing uniform molten pools confined to the contact points, ensuring homogeneous welding bonds at the points of intersection 15 between the lattice bars 4, 5.

Figure 13:
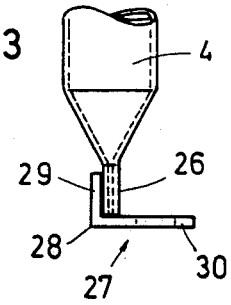

In the lattice jacket 3 according to FIG. 13, the lower ends 26 of the vertical lattice bars 4 are compressed into central, flat extensions welded with one broad side to the inside of the short leg 29 of a border profile 27 extending around the lattice shell, this profile being designed as an angular profile member 28, the long leg 30 of which serves for attaching the lattice shell 3 to a wooden pallet or a steel pipe pallet.

Figure 14:
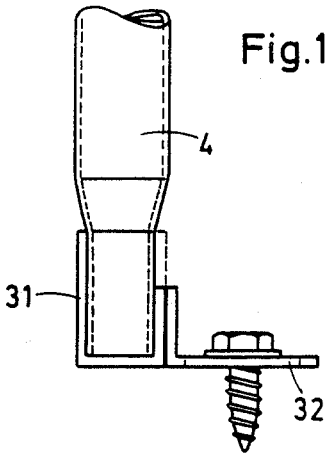

In the lattice shell design according to FIG. 14, the lower ends of the vertical lattice bars 4 are constricted or exhibit opposed flattened portions and are welded to a continuously extending U-shaped profile member 31. Mounting angles 32 can be welded to the leg of the U-shaped profile member 31, the lattice shell 3 being attached by means of these angles to a wooden pallet or to a steel pipe pallet. In the same way, the upper border of the lattice shell 3 can be designed as well, in which case the U-shaped profile 31 serves as the upper end profile 33 of the lattice shell 3 (FIG..5).

Figure 15:
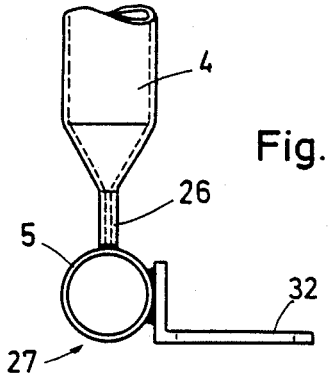

The lattice shell arrangement illustrated in FIG. 15 is characterized in that the lower ends 26 of the vertical lattice bars 4 are compressed to central, flat extensions and are butt-welded to a horizontally extending lattice bar 5 forming the lower border profile member 27, mounting angles 32 being welded to this bar. Without a mounting angle 32, this embodiment can be utilized for the upper termination of the lattice shell 3, the lattice bar 5 constituting the upper border profile 33 (FIG. 5).

Figure 16:
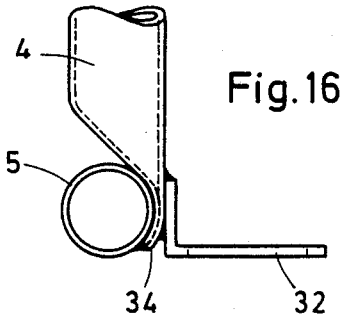

In the embodiment of FIG. 16, the lower end of the vertical lattice bar 4 is unilaterally compressed and fashioned, at the squeezed end 34, to be arcuate approximately in the radius of the horizontal lattice bar 5 and is welded to the latter; the mounting angles 32 can be welded in place at this arcuately compressed end 34 of the lattice bar 4 or at another place between two vertical lattice bars 4. Also this embodiment is suited for forming the upper border of the lattice shell 3.

Figure 17:
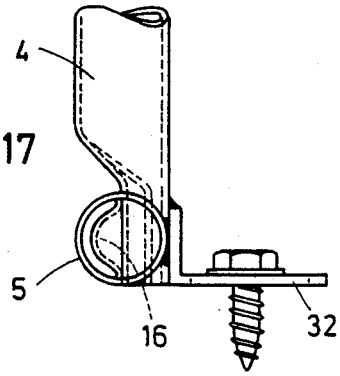

A possible but less preferred embodiment is shown in FIG. 17. In this arrangement, the lower ends of the vertical lattice bars 4 are welded to a continuously extending, horizontal lattice bar 5, such as at a point of intersection 15 in the zone of trough-like depressed indentations 16, the indentation of the vertical lattice bar 4 being provided approximately to three-fourths thereof. Also in this embodiment, mounting angles 32 can be welded in place. Without mounting angles 32, this arrangement can also serve as the upper termination of the lattice shell 3.

Figure 18:
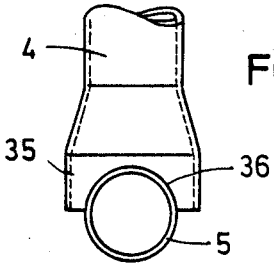

FIG. 18 shows a further possibility of connecting the vertical lattice bars 4 to a border profile 27 or 33 in the form of a horizontal lattice bar 5. In this example, the lower end 35 of each vertical lattice bar 4 is compressed into a central, flat extension and is butt-welded to the lattice bar 5 with an approximately semicircular recess 36.

In the embodiment of FIG. 19, the lower end 37 of each vertical lattice bar 4 is compressed in the form of a spherical segment and is welded to a horizontal lattice bar 5.

FIG. 20 shows another, especially simple version wherein the lower or upper end of each vertical lattice bar 4 is attached, without being shaped, to a continuously extending angular profile member 38 by way of welding projections or nubs (not shown).

Figure 3:
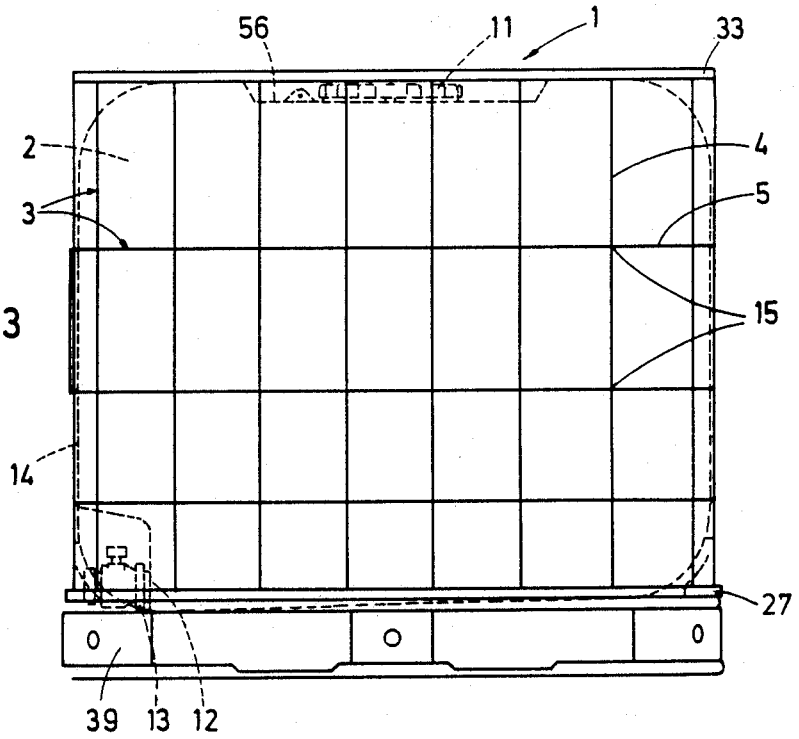
FIG. 3 shows a lateral view of a pallet container with a steel pipe pallet.
Figure 4:
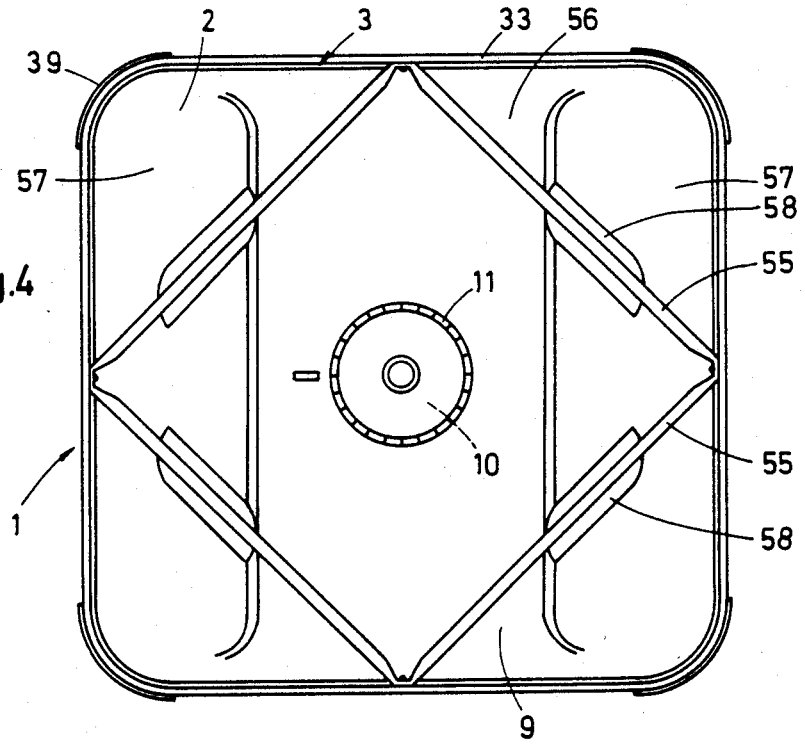
FIG. 4 shows a top view of the pallet container according to FIG. 3.

In the mounting of the lattice shell 3 of the pallet container 1 according to FIGS. 3 and 4 to a steel pipe pallet 39, depicted in FIG. 21, Z-shaped profiled fishplates 40 are welded to the lower, continuously extending horizontal lattice bar 5, between the mounting angles 32, by means of an upper flange 41 joined via a connecting web 42 with a downwardly projecting flange 43, the latter contacting on the inside the upper tubular frame 44 of the steel pipe pallet 39.

FIGS. 22 and 23 show two possibilities of a butt joint connection of the lattice shell 3. According to FIG. 22, two vertical lattice bars 4 are welded together at 45 at least in certain locations; the meeting ends of the horizontal lattice bars 5 are compressed into extensions 46 offset eccentrically by the radius of the lattice bar, shaped in the manner of an arc, and welded to the vertical lattice bars 4.

In the butt joint connection of the lattice shell 3 according to FIG. 23, the ends of the horizontal lattice bars 5 are compressed into pointed extensions 47 offset eccentrically by the lattice bar radius, these extensions being welded to one another and to a vertical lattice bar 4 at 48.

In order to mount the pallet container 1 of FIGS. 1 and 2 on a wooden pallet 7, screw bolts 49 extending from the sheet-metal bottom 6 and, respectively, from the mounting angles 32 of the lattice shell 3 are utilized, these bolts reaching into the lower boards of the wooden pallet 7 and being tightened by means of nuts 51 at that location in milled-out recesses 50. This results in a rugged connection of pallet container 1 and wooden pallet 7. FIG. 24 furthermore shows the drawn-in lower end 52 of a vertical lattice bar 4 welded into a continuously extending U-shaped profile member 53, the latter being in each case fastened to the wooden pallet 7 by means of screws 54 between two vertical lattice bars 4.

According to FIGS. 2 and 4, the pallet container 1 exhibits, in place of a lid, a reinforcing frame made up of diagonally arranged tubular struts 55 threaded to the lower border profile 33 in the center of the lateral spans of the latter and being removable for lifting out the synthetic resin inner container 2. Since the upper wall 9 of the inner synthetic resin container 2 accommodates the filling port 10 and the screw-on lid 11 thereof in a depression 56, oblique troughs 58 are provided in the raised portions 57 flanking this depression 56; the tubular struts 55 extend through these troughs so that they disappear at that location within the contour of the upper wall 9 of the inner container 2.

As can be seen from FIGS. 1, 3 and 5, the mutual spacings of the horizontal lattice bars 5 gradually increase from the bottom toward the top so that in the bottom zone of the lattice shell 3, on account of the more closely juxtaposed horizontal lattice bars 5, the necessary resistance moment is ensured with respect to the internal pressure forces acting on the wall of the inner container 2 and rising with the filling level.

I claim:

1. Pallet container with a flat pallet, an exchangeable inner container of a synthetic resin with an upper filling port and a lower discharge means, as well as with an outer shell surrounding the inner container, with vertical and horizontal lattice bars of metal, the outer shell (3) comprising lattice bars (4, 5) fashioned as pipes, these bars being in close contact with the outer wall (14) of the synthetic resin inner container (2); the vertical and horizontal lattice bars (4, 5) being deformed, at points of intersection (15), for the formation of trough-like, double-walled indentations (16) extending in the longitudinal direction of the lattice bars, in such a way that two curved longitudinal rims (18, 19) of a wall (17) of the indentations (16) of each lattice bar (4, 5) extend between a tangential plane (20-20) and a secant plane (21-21) of the lattice bar (4, 5), this latter plane being parallel to the former plane, and there being, at each of the points of intersection (15) between the longitudinal rims (18, 19) of the indentations (16) of two rectangularly superimposed lattice bars (4, 5), four contact points (22) located in one plane (21-21) with an accumulation of material corresponding in each case to four times a lattice bar wall thickness (23); the lattice bars (4, 5) are joined by means of welding of the four contact points (22) at each point of intersection (15) in such a way that the bars (4, 5) have common tangential planes (20-20, 25-25) on the inside and outside of the bars.

2. Pallet container according to claim 1, wherein the lower ends (26) of the vertical lattice bars (4) are compressed to central, flat extensions welded with one broad side to the inside of a short leg (29) of an angular profile member (28) extending around the outer shell (3).

3. Pallet container according to claim 1, wherein ends of the vertical lattice bars (4) exhibit opposed flattened portions or are constricted and are attached in a continuously extending U-shaped profile member (31); and mounting angles (32), uniformly distributed along the periphery of the outer shell (3), are connected to an inner leg of the U-shaped profile member (31).

4. Pallet container according to claim 1, wherein lower ends (26) of the vertical lattice bars (4) are compressed into central, flat extensions and are butt-welded onto a continuously extending, horizontal lattice bar (5) to which mounting angles (32) are connected by welding.

5. Pallet container according to claim 1, wherein lower ends (34) of the vertical lattice bars (4) are compressed on one side in the manner of an arc and are welded to a horizontal, continuously extending lattice bar (5).

6. Pallet container according to claim 1, wherein lower ends of the vertical lattice bars (4) are welded to a horizontal lattice bar (5) extending all around the outer shell (3), in the region of trough-like drawn-in indentations (16); and inwardly projecting mounting angles (32) welded to at least several vertical lattice bars (4).

7. Pallet container according to claim 1, wherein ends (35) of the vertical lattice bars (4) are compressed to central, flat extensions and are butt-welded, with an approximately semicircular recess (36), to a lattice bar (5) that extends all around the outer shell (3).

8. Pallet container according to claim 1, wherein ends (37) of the vertical lattice bars (4) are compressed in the manner of a spherical segment and are butt-welded to a lattice bar (5) that extends all around the outer shell (3).

9. Pallet container according to claim 1, wherein ends of the vertical lattice bars (4) are welded into an angular profile member (38) that extends all around the outer shell (3).

10. Pallet container according to claim 1 with a steel pipe pallet, wherein fishplates (40) bent into a Z-shape are welded to a lattice bar that extends all around the bottom of the outer shell (3), at spacings between mounting angles (32), these fishplates contacting an upper tubular frame (44) of the steel pipe pallet (39) from the inside.

11. Pallet container according to claim 1, wherein two vertical lattice bars (4) are welded together; and ends of the horizontal lattice bars (5) are compressed into extensions (46) offset eccentrically by a pipe radius, these extensions being shaped to be arcuate and being welded to respective vertical lattice bars (4).

12. Pallet container according to claim 1, wherein the ends of the horizontal lattice bars (5) are compressed into pointed extensions (47) offset eccentrically by a lattice bar radius, these extensions being welded to one another and to a vertical lattice bar (4).

13. Pallet container according to claim 1, wherein four diagonally arranged upper tubular struts (55) are threaded, in the center of the sides of the lattice shell (3), to an upper, continuously extending profile member (33).

14. Pallet container according to claim 13, wherein an upper wall (9) of the synthetic resin inner container (2) exhibits, on both sides of a depression (56) accommodating an upper filling port (10) with screw-on lid (11), obliquely formed troughs (58) for the accommodation of diagonal tubular struts (55).

15. Pallet container according to claim 1 with a wooden pallet, wherein mounting angles (32) are threaded in place, at least in corner regions of the pallet (7), by means of screw bolts (49) extending into lower wooden boards of the pallet (7).

16. Pallet container according to claim 1, wherein the spacings of the horizontal lattice bars (5) of the lattice shell (3) increase from the bottom toward the top.

* * * * *

US004909387C1

(12) EX PARTE REEXAMINATION CERTIFICATE (5249th)

United States Patent
Schutz

(10) Number: US 4,909,387 C1
(45) Certificate Issued: Jan. 3, 2006

(54) PALLET CONTAINER WITH AN EXCHANGEABLE INNER CONTAINER OF A SYNTHETIC RESIN AND AN OUTER JACKET OF METAL LATTICE BARS

(75) Inventor: Udo Schutz, Selters (DE)

(73) Assignee: Protechna SA, Fribourg (CH)

Reexamination Request:
No. 90/005,524, Sep. 30, 1999
No. 90/006,722, Jul. 22, 2003

Reexamination Certificate for:
Patent No.: 4,909,387
Issued: Mar. 20, 1990
Appl. No.: 07/296,125
Filed: Jan. 12, 1989

(30) Foreign Application Priority Data

Nov. 24, 1998 (DE) ..... P 38 39 647

(51) Int. Cl.
*B65D 19/00* (2006.01)

(52) U.S. Cl. ..... 206/386; 220/1.5; 220/23.87; 220/485

(58) Field of Classification Search ..... 206/386; 220/1.5, 23.87, 485
See application file for complete search history.

(56) References Cited

U.S. PATENT DOCUMENTS

| | | | | |
|---|---|---|---|---|
| 2,467,636 A | 4/1949 | Stoudt et al. | ..... | 219/4 |
| 2,967,228 A | 1/1961 | Tindall | ..... | 219/119 |
| 3,707,033 A | 12/1972 | Knott | ..... | 29/460 |
| 4,676,373 A | 6/1987 | Schneider | ..... | 206/386 |
| 4,909,387 A | 3/1990 | Schutz | ..... | 206/386 |

FOREIGN PATENT DOCUMENTS

| | | |
|---|---|---|
| DE | 2655268 A1 * | 6/1978 |
| DE | 26 55 268 | 8/1978 |
| DE | 2811655 | 9/1979 |
| FR | 1247439 | 10/1960 |
| FR | 2573388 | 11/1985 |

* cited by examiner

*Primary Examiner*—Jim Foster

(57) ABSTRACT

The pallet container comprises a wooden pallet or a steel pipe pallet, on which is mounted an inner container of a synthetic resin with a jacket of vertical and horizontal lattice bars (4, 5) of steel pipe, these bars forming continuous inner and outer tangential planes; (20-20, 25-25). At the points of intersection (15), the lattice bars are drawn in to form trough-like indentations. This configuration has the result that, at each point on intersection (15), four contact points (22) disposed in one plane (21-21) are produced with an accumulation of material in each case corresponding to four times the wall thickness of the lattice bars. The lattice bars (4, 5) are joined together at the points of intersection (15) in the zone of the contact points (22) by electric resistance welding. The pallet container is usable as a safely operating multiple-trip container for liquid merchandise of all kinds.

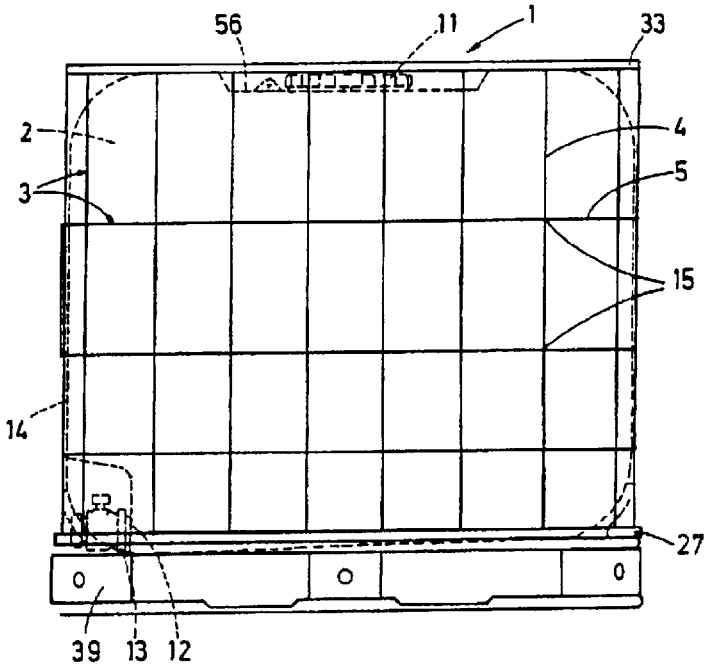

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–16, dependent on an amended claim, are determined to be patentable.

New claims 17–31 are added and determined to be patentable.

1. Pallet container with a flat pallet, an exchangeable inner container of a synthetic resin with an upper filling port and a lower discharge means, as well as with an outer shell surrounding the inner container, with vertical and horizontal lattice bars of metal, the outer shell (3) comprising lattice bars (4, 5) fashioned as pipes, these bars being in close contact with the outer wall (14) of the synthetic resin inner container (2); the vertical and horizontal lattice bars (4, 5) being deformed, at points of intersection (15), for the formation of trough-like, double-walled indentations (16) extending in the longitudinal direction of the lattice bars, in such a way that two curved longitudinal rims (18, 19) of a wall (17) of the indentations (16) of each lattice bar (4, 5) extend between a tangential plane (20-20) and a secant plane (21-21) of the lattice bar (4, 5), this latter plane being parallel to the former plane, and there being, at each of the points of intersection (15) between the longitudinal rims (18, 19) of the indentations (16) of two rectangularly superimposed lattice bars (4, 5), four contact points (22) located in one plane (21-21) with an accumulation of material corresponding in each case to four times a lattice bar wall thickness (23); the lattice bars (4, 5) are joined by means of [welding] *a resistance forge weld* of the four contact points (22) at each point of intersection (15) in such a way that the bars (4, 5) have common tangential planes (20-20, 25-25) on the inside and outside of the bars.

*17. Pallet container with a flat pallet, an exchangeable inner container of a synthetic resin with an upper filling port and a lower discharge means, as well as with an outer shell surrounding the inner container, with vertical and horizontal lattice bars of metal, the outer shell (3) comprising lattice bars (4, 5) fashioned as pipes, these bars being in close contact with the outer wall (14) of the synthetic resin inner container (2); the vertical and horizontal lattice bars (4, 5) being deformed, at points of intersection (15), for the formation of trough-like, double-walled indentations (16) extending in the longitudinal direction of the lattice bars, in such a way that two curved longitudinal rims (18, 19) of a wall (17) of the indentations (16) of each lattice bar (4, 5) extend between a tangential plane (20-20) and a secant plane (21-21) of the lattice bar (4, 5), this latter plane being parallel to the former plane, and there being, at each of the points of intersection (15) between the longitudinal rims (18, 19) of the indentations (16) of two rectangularly superimposed lattice bars (4, 5), four contact points (22) located in one plane (21-21) with an accumulation of material corresponding in each case to four times a lattice bar wall thickness (23); the lattice bars (4, 5) are joined by means of welding of the four contact points (22) at each point of intersection (15) in such a way that the bars (4, 5) have common tangential planes (20-20, 25-25) on the inside and outside of the bars, wherein four diagonally arranged upper tubular struts (55) are threaded, in the center of the sides of the lattice shell (3), to an upper continuously extending profile member (33), and wherein an upper wall (9) of the synthetic resin inner container (2) exhibits, on both sides of a depression (56) accommodating an upper filling port (10) with screw-on lid (11), obliquely formed troughs (58) for the accommodation of diagonal tubular struts (55).*

*18. Pallet container according to claim 17, wherein the lower ends (26) of the vertical lattice bars (4) are compressed to central, flat extensions welded with one broad side to the inside of a short leg (29) of an angular profile member (28) extending around the outer shell (3).*

*19. Pallet container according to claim 17, wherein ends of the vertical lattice bars (4) exhibit opposed flattened portions or are constricted and are attached in a continuously extending U-shaped profile member (31); and mounting angles (32), uniformly distributed along the periphery of the outer shell (3), are connected to an inner leg of the U-shaped profile member (31).*

*20. Pallet container according to claim 17, wherein lower ends (26) of the vertical lattice bars (4) are compressed into central, flat extensions and are butt-welded onto a continuously extending, horizontal lattice bar (5) to which mounting angles (32) are connected by welding.*

*21. Pallet container according to claim 17, wherein lower ends (34) of the vertical lattice bars (4) are compressed on one side in the manner of an arc and are welded to a horizontal, continuously extending lattice bar (5).*

*22. Pallet container according to claim 17, wherein lower ends of the vertical lattice bars (4) are welded to a horizontal lattice bar (5) extending all around the outer shell (3), in the region of trough-like drawn-in indentations (16); and inwardly projecting mounting angles (32) welded to at least several vertical lattice bars (4).*

*23. Pallet container according to claim 17, wherein ends (35) of the vertical lattice bars (4) are compressed to central, flat extensions and are butt-welded, with an approximately semicircular recess (36), to a lattice bar (5) that extends all around the outer shell (3).*

*24. Pallet container according to claim 17, wherein ends (37) of the vertical lattice bars (4) are compressed in the manner of a spherical segment and are butt-welded to a lattice bar (5) that extends all around the outer shell (3).*

*25. Pallet container according to claim 17, wherein ends of the vertical lattice bars (4) are welded into an angular profile member (38) that extends all around the outer shell (3).*

*26. Pallet container according to claim 17 with a steel pipe pallet, wherein fishplates (40) bent into a Z-shape are welded to a lattice bar that extends all around the bottom of*

*the outer shell (3), at spacings between mounting angles (32), these fishplates contacting an upper tubular frame (44) of the steel pipe pallet (39) from the inside.*

*27. Pallet container according to claim 17, wherein two vertical lattice bars (4) are welded together; and ends of the horizontal lattice bars (5) are compressed into extensions (46) offset eccentrically by a pipe radius, these extensions being shaped to be arcuate and being welded to respective vertical lattice bars (4).*

*28. Pallet container according to claim 17, wherein the ends of the horizontal lattice bars (5) are compressed into pointed extensions (47) offset eccentrically by a lattice bar radius, these extensions being welded to one another and to a vertical lattice bar (4).*

*29. Pallet container according to claim 17, wherein four diagonally arranged upper tubular struts (55) are threaded, in the center of the sides of the lattice shell (3), to an upper, continuously extending profile member (33).*

*30. Pallet container according to claim 17 with a wooden pallet, wherein mounting angles (32) are threaded in place, at least in corner regions of the pallet (7), by means of screw bolts (49) extending into lower wooden boards of the pallet (7).*

*31. Pallet container according to claim 17, wherein the spacings of the horizontal lattice bars (5) of the lattice shell (3) increase from the bottom toward the top.*

* * * * *